US005791018A

United States Patent [19]

Yoshinobu

[11] Patent Number: 5,791,018

[45] Date of Patent: Aug. 11, 1998

[54] AUTOMOBILE HINGE STRUCTURE

[75] Inventor: Furuse Yoshinobu, Wako, Japan

[73] Assignee: Honda Giken Kogyo Kabushiki Kaisha, Tokyo, Japan

[21] Appl. No.: 754,616

[22] Filed: Nov. 21, 1996

Related U.S. Application Data

[63] Continuation of Ser. No. 394,330, Feb. 24, 1995, abandoned.

[30] Foreign Application Priority Data

Mar. 22, 1994 [JP] Japan ..... 6-050862

[51] Int. Cl.[6] ..... E05D 5/00; E05D 11/06

[52] U.S. Cl. ..... 16/374; 16/385; 16/387

[58] Field of Search ..... 16/255, 259–263, 16/265, 270, 374, 377, 389–392, 387

[56] References Cited

U.S. PATENT DOCUMENTS

| | | | |
|---|---|---|---|
| 1,363,372 | 12/1920 | Soss | 16/389 |
| 2,122,831 | 7/1938 | Atwood et al. | 16/389 |
| 5,067,201 | 11/1991 | Marchione | 16/270 |
| 5,361,455 | 11/1994 | Kiefer | 16/587 |

FOREIGN PATENT DOCUMENTS

| | | | |
|---|---|---|---|
| 3128068 | 2/1983 | Germany | 16/374 |
| 62-9710 | 3/1987 | Japan . | |
| 771964 | 4/1957 | United Kingdom | 16/390 |
| 1437454 | 5/1976 | United Kingdom | 16/389 |

*Primary Examiner*—Daniel W. Howell
*Assistant Examiner*—Donald M. Gurley
*Attorney, Agent, or Firm*—Armstrong, Westerman, Hattori, McLeland & Naughton

[57] ABSTRACT

An automobile hinge structure has one of a hinge male member and a hinge female member configured by side pieces which have hinge pin holes and are arranged in parallel with a space therebetween, a vertical front piece for connecting the side pieces, and a base piece. The front piece is disposed to be substantially orthogonal with the base piece in a plan view. Such hinge structure has an L-shaped plan view and a square C-shaped vertical cross section with reduction of plate thickness and weight of hinge members, high strength and high rigidity. The reduction in the plate thickness facilitates forming and simplifies a forming mold.

5 Claims, 5 Drawing Sheets

Fig.4
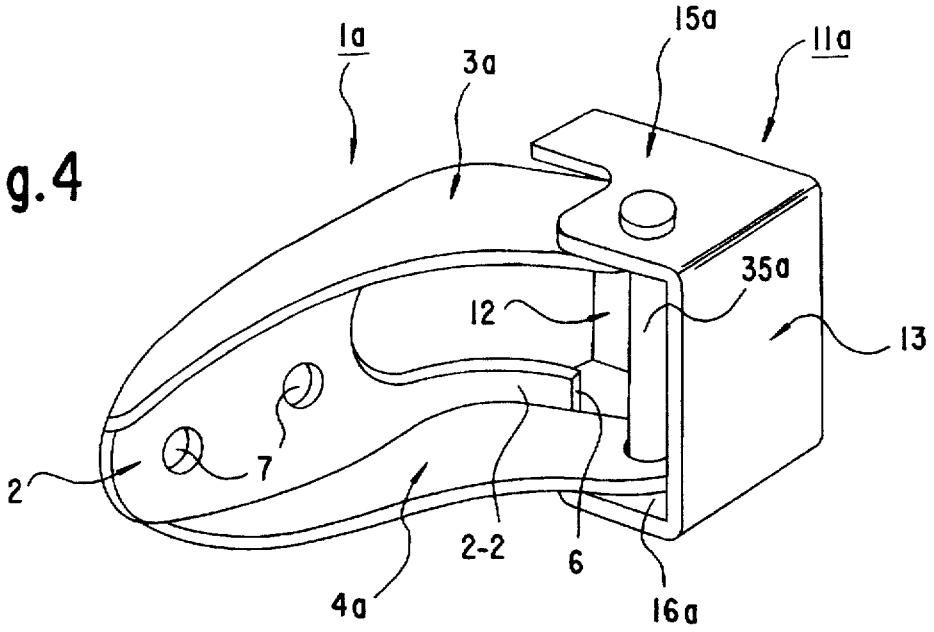
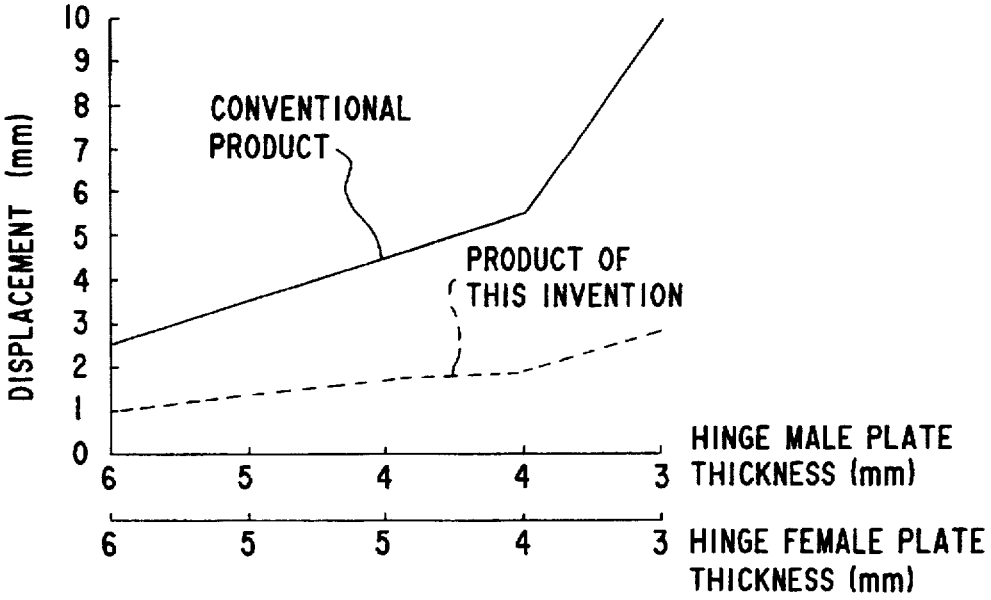
Fig.5

AUTOMOBILE HINGE STRUCTURE

This application is a continuation of application Ser. No. 08/394,330 filed Feb. 24, 1995, now abandoned.

BACKGROUND OF THE INVENTION

1. Field of the Invention

This invention relates to improvements of a hinge structure for pivotably mounting doors, a hood, and a trunk lid to car body openings such as doors, an engine room, and a trunk room.

2. Description of the Related Art

Such hinges have been disclosed in Japanese Patent Publication No. 62-9710.

The technology disclosed in the above publication is as shown in FIG. 7 and FIG. 8.

FIG. 7 shows an ordinary door hinge technology. A hinge in this drawing consists of a first hinge member 152 and a second hinge member 154. The first hinge member 152 is fixed to the outside wall of an opening 151-1 of a car body 151 via base plate 152-3 having a schematically L-shaped appearance in a plan view and provided with top and bottom outwardly extending supporting pieces 152-1, 152-2. The second hinge member 154 is fixed to a front end 153-1 of a door 153. The second hinge member 154 has foot pieces 154-3, 154-3 extendedly disposed at right angles from the back ends of top and bottom supporting pieces 154-1, 154-2 which, with vertical bridge piece 154, form, in side view, a square C-shape. Foot pieces 154-3, 154-3 are secured to the front end 153-1 of the door 153 by screws or welding. The front ends of the top and bottom supporting pieces 154-1, 154-2 of the hinge member 154 are integrally connected by vertical bridge-piece 154-4. The hinge member 154 is a press-formed product made of a steel plate material.

The respective supporting pieces 154-1, 154-2 of second hinge member 154 and outwardly extending support pieces 152-1, 152-2 of first hinge member 152, are placed one upon another, with the pin holes therein in registry, and a hinge pin 155 is vertically inserted through such pin holes to pivotably engage the hinge member 154 and the hinge member 152, thereby openably mounting the door 153 to the body opening 151-1.

The above technology has disadvantages that the square C-shaped structure of hinge male member 154 on the door side results in applying a vertical moment to the top and bottom supporting pieces 154-1, 154-2, which are only supported by the bridge piece 154-4 at their ends, thus easily deforming these pieces 154-1, 154-2 downward due to a downward load of the door 153. This results in a disadvantage of mis-alignment of the door 153. To avoid this disadvantage, it is necessary to make the hinge member thicker and more rigid. But, making such member thicker increases the weight of the member and is not preferable. Additionally, the increase of the plate thickness makes press-formed of such hinge member more difficult.

On the other hand, FIG. 8 shows a modification in that the vertical bridge piece 154-4*a* is integrally formed with the ends of the top and bottom pieces 154-1*a*, 154-2*a* of hinge member 154*a*. Comparing with the embodiment of FIG. 7, the modification of FIG. 8 provides improvements in preventing the deformation from occurring. However, the modification of FIG. 8 is not a drastic solution because the supporting pieces 154-1*a*, 154-2*a* are supported by only one bridge piece 154-4*a* whose position is different from the embodiment of FIG. 7. This technology still has difficulty in solving the disadvantage of the embodiment of FIG. 7 of easy deformation due to door load. Therefore, the hinge member 154-4*a* must be made thick to solve the disadvantage, resulting in the same difficulty as in the embodiment of FIG. 7 with the same disadvantages, such as, an increase of the hinge member plate thickness, weight increase, and difficulty in forming.

Furthermore, the technology shown in FIG. 8 integrally forms the bridge piece 154-4*a* with the ends of the top and bottom supporting pieces 154-1*a*, 154-2*a* of the hinge member 154*a*, making the press forming difficult. More specifically, a plurality of processes are required to form such hinge member, its forming is troublesome and complicated, and a forming metal mold is required to be multiple, such as, a split metal mold, resulting in disadvantages that the forming metal mold becomes complex and total cost is increased.

The above prior technologies have disadvantages which require solutions.

SUMMARY OF THE INVENTION

In an automobile first hinge structure consisting of a hinge member, a second hinge member, and a vertical hinge pin for connecting the first hinge member and the second hinge member, this invention provides an automobile hinge structure wherein at least one of the first hinge member and the second hinge member consists of top and bottom horizontal side pieces each provided with a pin hole for pivotably fitting the hinge pin, a vertical base piece for connecting such side pieces, and a front piece which is substantially orthogonal to the base piece in plan view.

This invention also provides an automobile hinge structure wherein one of the first hinge female member or the second hinge member is formed by a single press-forming process.

This invention can support a downward load applied to the second hinge member by the base piece and the front piece. When the door load is supported by the base piece of the hinge male member secured to the door end, the vertical load applied to the base piece can be supported by the front piece. Thus, whichever direction the downward load is applied to the second hinge member, this load can be supported by the base piece, the front piece or both of them.

Therefore, the above hinge structure, when used for a car door hinge, prevents the hinge from being deformed because of the door load, and can provide satisfactory strength and rigidity. These advantages can be attained without increasing the thickness of the second hinge member plate thickness but with its thickness decreased. Consequently, contradictory requirements for the reduction in plate thickness and weight of the second hinge member and its high strength and high rigidity are rationally satisfied, and the plate thickness is not increased but such second hinge member can be made thin, so that such second the hinge male member can be easily formed. As a result, the forming metal mold can be simplified. The cost of the second hinge member can be reduced.

BRIEF DESCRIPTION OF THE SEVERAL VIEWS OF THE DRAWINGS

The present invention will be more fully described and will be better understood from the following descriptions of preferred embodiments of the invention, taken with the appended drawings, in which

FIG. 4 is a perspective view of a modified embodiment of the hinge structure of this invention;

FIG. 5 is a graph comparing plate thicknesses and displacements of a conventional produce and the product of this invention;

DETAILED DESCRIPTION OF THE INVENTION

Figure 1:
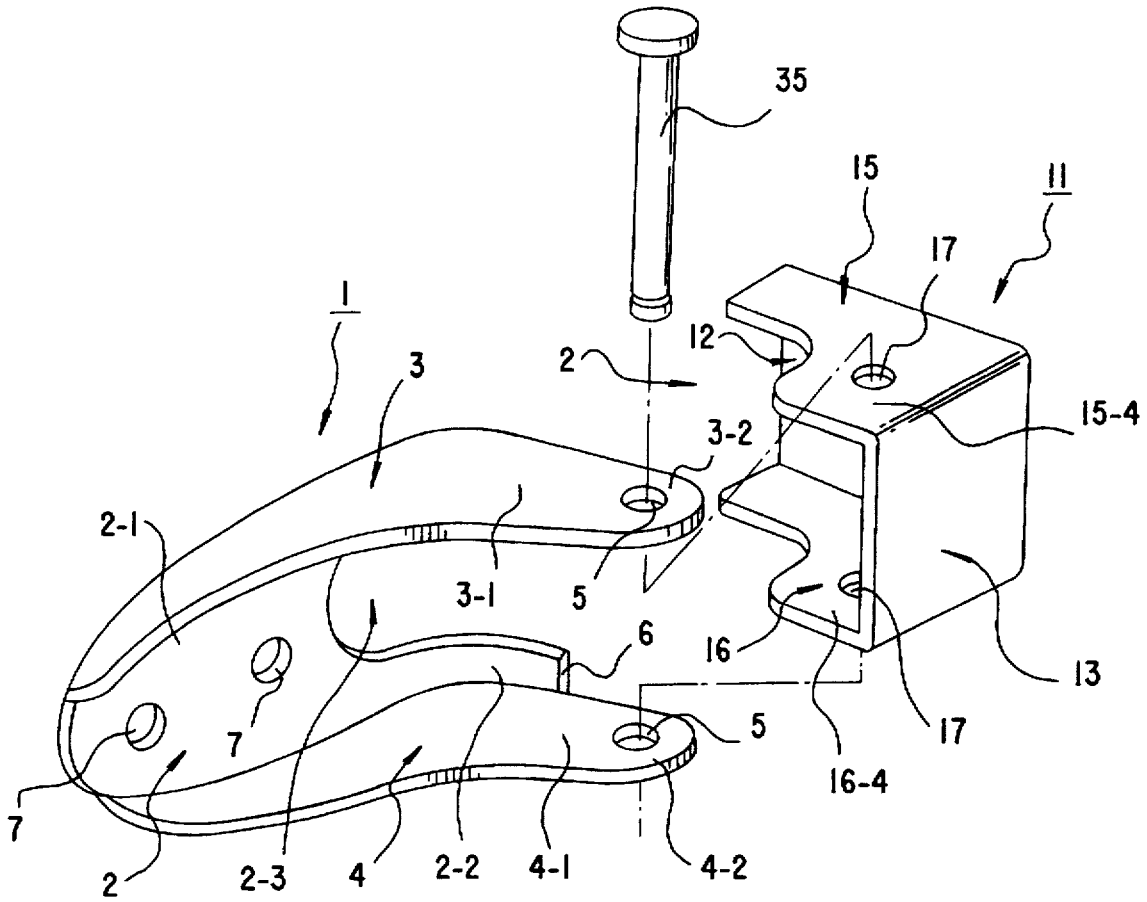
FIG. 1 is an exploded perspective view of a hinge structure of this invention.

FIG. 1 is an exploded perspective view showing a first hinge member 1 and a second hinge member 11 which, when assembled, form a hinge structure.

In the embodiments, the hinge structure is used for an automobile door hinge mechanism but can also be used, as it is, for hood and trunk lid hinges, for example.

Figure 3:
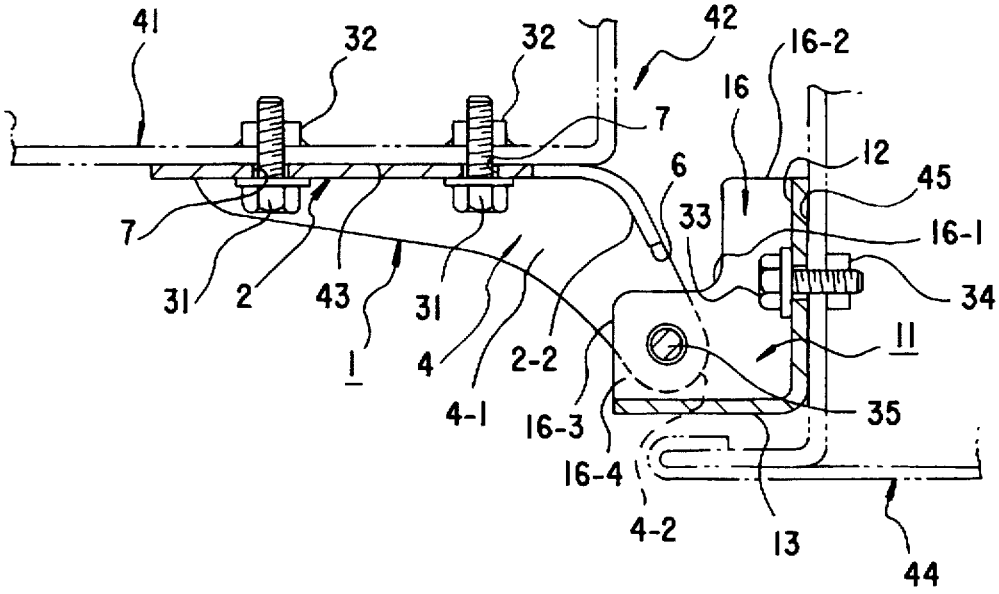
FIG. 3 is a transverse plan view, partly in section, showing a first hinge member and a second hinge member as attached to a car body and a door.

The first hinge member 1, shown at the left side in FIG. 1, is fixed to a fitting face 43 of a door opening 42 of a car body 41 as shown in FIG. 3. The first hinge member 1, described in detail with reference to FIG. 1, has a square C-shaped cross section and a flat fitting seating face 2. From the top and bottom ends of the seating face 2, top and bottom supporting pieces 3, 4 are bent at right angles and protruded. The top and bottom supporting pieces 3, 4 are arranged in parallel and separated from each other by the width of seating face 2. The top and bottom supporting pieces 3, 4 have tongues 3-1, 3-2, 4-1, 4-2 extended forward to form curved L shapes from the seating face. The tongues 3-1, 4-1 have coaxial pin holes 5, 5 for pivotable fitting formed in leading ends 3-2, 4-2.

A base 2-1 of the seating face 2 is flat, and is extended to form top and bottom bifurcated leading sections 2-2, and a U-shaped space 2-3 is formed between the bifurcated leading sections 2-2. The bifurcated leading sections 2-2, 2-2 extended in a curved state along the tongues 3-1, 4-1 of the top and bottom supporting pieces 3, 4. The bifurcated leading sections 2-2, 2-2 have their leading ends terminated before the leading ends of the tongue 3-1, 4-1 of the supporting pieces 3, 4 to form stoppers 6, 6 at the leading ends of the bifurcated leading sections 2-2, 2-2.

The drawing shows the bottom bifurcated leading section 2-2 and the bottom stopper 6 only on tongue 4-1, but the same leading section 2-2 and stopper 6 are also formed on tongue 3-1.

The base 2-1 of the seating face 2 of the above hinge female member 1 has two separate fitting holes 7, 7. The hinge female member 1 is, preferably, integrally formed by press-forming a steel plate.

As shown in FIG. 3, the above first hinge member 1 has the back face of the base 2-1 of the seating face 2 placed upon the fitting face 43 of the car body, bolts 31, 31 are put in the fitting holes 7, 7 and screwed into welded nuts 32, 32 on the back face of the fitting face 43 to secure the first hinge member 1. The hinge female member 1 is not always required to be secured by screwing, as described above, but may be fixed by welding the base 2-1 of the seating face 2 to the fitting face 43.

As shown in FIG. 3, the second hinge member 11, shown at the right side in FIG. 1, is fixed to a fitting face 45, FIG. 3, at the end of a door 44 for opening or closing the opening 42 of the car body 41.

Figure 2:
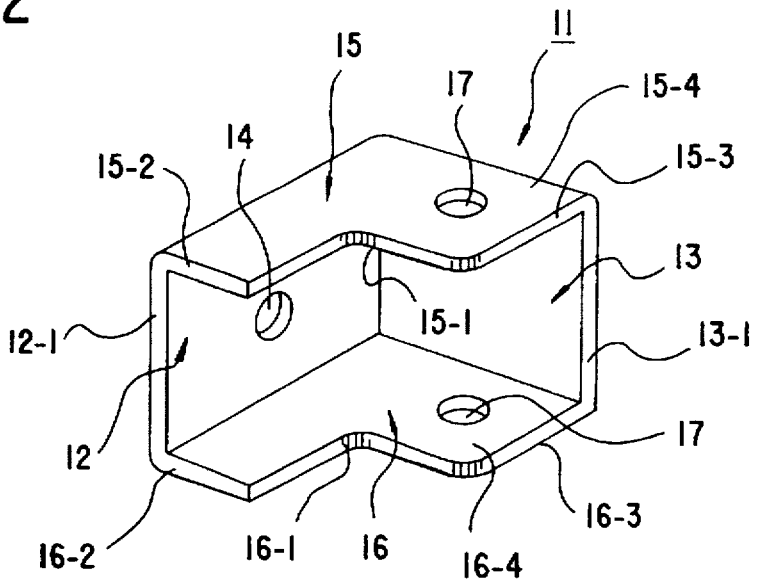
FIG. 2 is a perspective view of a first hinge member as seen in the direction of the arrow 2 in FIG. 1.

FIG. 2 shows that the second hinge member 11 has an L-shaped transverse cross section and is provided with a base piece 12 and a front piece 13 intersected almost at right angles in plan view. More specifically, the base piece 12 is provided with a fitting hole 14, the front piece 13 is continuous from the end of the base piece 12 and bent at right angles at and extended from the end of base piece 12.

To both sides (top and bottom ends in the drawing) of the base piece 12 and the front piece 13, formed in the L shape as described above, side pieces 15, 16, bent at right angles, are integrally and continuously disposed. The side pieces 15, 16 are parallel and apart from each other for the width of the base piece 12 and the front piece 13.

The side pieces 15, 16 have a wide L shape in a plan view and are provided with L-shaped ends 15-1, 16-1. Sides 15-2, 15-3, 16-2 and 16-3 of the L-shaped ends 15-1, 16-1 intersect with open side ends 12-1, 13-1 of the base piece 12 and the front piece 13.

Supporting pieces 15-4, 16-4 are side walls of the front piece 13 of the top and bottom side pieces 15, 16 of the second hinge member 11. The supporting pieces 15-4, 16-4 are provided with coaxial pin holes 17, 17 for pivotable fitting so as to correspond to the pin holes 5, 5 for pivotable fitting of the above first hinge member 1.

The second hinge member 11 is formed by a single forming processing which a steel plate material is pressed into a prescribed shape and, the pin holes 17, 17 are then formed.

The metal mold for forming second member 11 is a pair of molds, such as, a top and bottom type which can form by simply dissociating. The second hinge member can be formed by a simple mold opening and closing operation without requiring a plurality of mold closing and opening works by using a split mold or a plurality of molds.

As shown in FIG. 3, second hinge member 11 has the back face of the base piece 12 placed upon the fitting face 45 of the door 44, FIG. 3, a bolt 33 is passed through the fitting hole 14 in this embodiment, and threaded into a welded nut 34 disposed on the back face of the fitting face 45 to secure second hinge member 11 to the door 44. Instead of securing with the bolt, the hinge member 11 may be fixed to the door by welding.

In the embodiment, a space between the supporting pieces 15-4 and 16-4 of the top and bottom side pieces 15, 16 of second hinge member 11 is determined to be slightly smaller than that between the top and bottom supporting pieces 3 and 4 of first hinge member 1. The supporting pieces 15-4, 16-4 of the top and bottom side pieces 15, 16 of hinge member 11 are held between the leading ends 3-2 and 4-2 of the top and bottom supporting pieces 3 and 4 of hinge member 1 with the pin holes 17, 17, 5 and 5 aligned, and a hinge pin 35 is inserted from above. The hinge pin 35 is fastened, such as, with a clip, so that it does not come out.

The L-shaped ends 15-1, 16-1 of second hinge member 11 (FIG. 3 shows the bottom end 16-1) are opposed to the stoppers 6, 6 of first hinge member 1 on the car body side with a space therebetween. When the door 44 is pivoted about the hinge pin 35, the end of the L-shaped end 16-1 (15-1) comes into contact with the stopper 6 to serve as a stopper.

Hinge member 11 has a structure that the side pieces 15, 16 are integrally connected to the base piece 12 and the front piece 13, so that a structure, which has a square C-shaped (channeled) cross section, has an L-shaped structure bent by 90 degrees in a plan view. More specifically, the base piece 12 including the top and bottom side pieces 15, 16 form the square C shape. This square C-shaped vertical cross section continues to the middle section, turns by 90 degrees at the middle section, while keeping the same cross section, and extended in the bent direction as a part of the front piece 13, including the top and bottom side pieces 15, 16. Consequently, high strength and high rigidity can be attained as a whole, and securing of the base piece 12 to the door, at one point, can provide high fitting strength and high rigidity. Therefore, one point threading or welding of hinge member 11 to the door is sufficient, reducing the manhour of securing the hinge member 11 to the door and improving the fitting efficiency.

On the other hand, at a point apart from the secured point on the door, the door load is downwardly applied to the top and bottom side pieces 15, 16 due to the hinge pin 35. But, because the hinge member 11 has the square C-shaped structure, in a vertical cross section where the top and bottom side pieces 15, 16 are connected to the base piece 12 and the front piece 13, strength and rigidity which can sufficiently resist a torsional moment with the hinge pin 35, as a core, can be retained. Thus, the hinge member 11 can be prevented from being deformed by the door load.

FIG. 5 is a graph comparing displacements of a conventional product and the product of this invention. The vertical axis shows a displacement (mm), the upper horizontal axis shows a plate thickness (mm) of second hinge member, and the lower horizontal axis a plate thickness (mm) of the hinge female member. The conventional hinge and the hinge of this invention were used to secure the door to the car body. With the door opened slightly, a 100-kg weight was hung at the door end to observe downward displacement of the door.

As shown in the graph of FIG. 5 that, when the same plate thickness is used for comparison, the product of this invention shown in broken line in FIG. 5, has two times, or more, smaller displacement than the conventional product shown in solid line in FIG. 5; namely the product of this invention has strength and rigidity of two times, or more as compared with the conventional product.

Thus, strength and rigidity can be determined to be high while reducing the thickness of the steel plate material forming the hinge structure. Therefore, the plate thickness can be reduced, and second hinge member can be formed quite easily because the plate thickness is reduced. Accordingly, contradictory requirements for the reduction of thickness and weight, easy forming, and high strength and high rigidity are rationally satisfied.

FIG. 4 is a perspective view of a modified embodiment of the hinge structure of this invention.

In this embodiment, the structures of second hinge member 11*a* and first hinge member 1*a* are not modified, and the same reference numerals are given to the same parts, so that the detailed description of such parts will be omitted.

In this embodiment, a space between the side pieces 15*a*, 16*a* of second hinge member 11*a* is determined to be larger than that between the supporting pieces 3*a* and 4*a* of first hinge member 1*a*, the side pieces 15*a*, 16*a* of second hinge member 11*a* are fitted to the outsides of the supporting pieces 3*a*, 4*a*, and they are pivotably engaged by means of the hinge pine 35*a*. This pivotably engaged structure of second hinge member 11*a* and first hinge member 1*a* has the same function and effect as those of the aforementioned structure.

Figure 6:
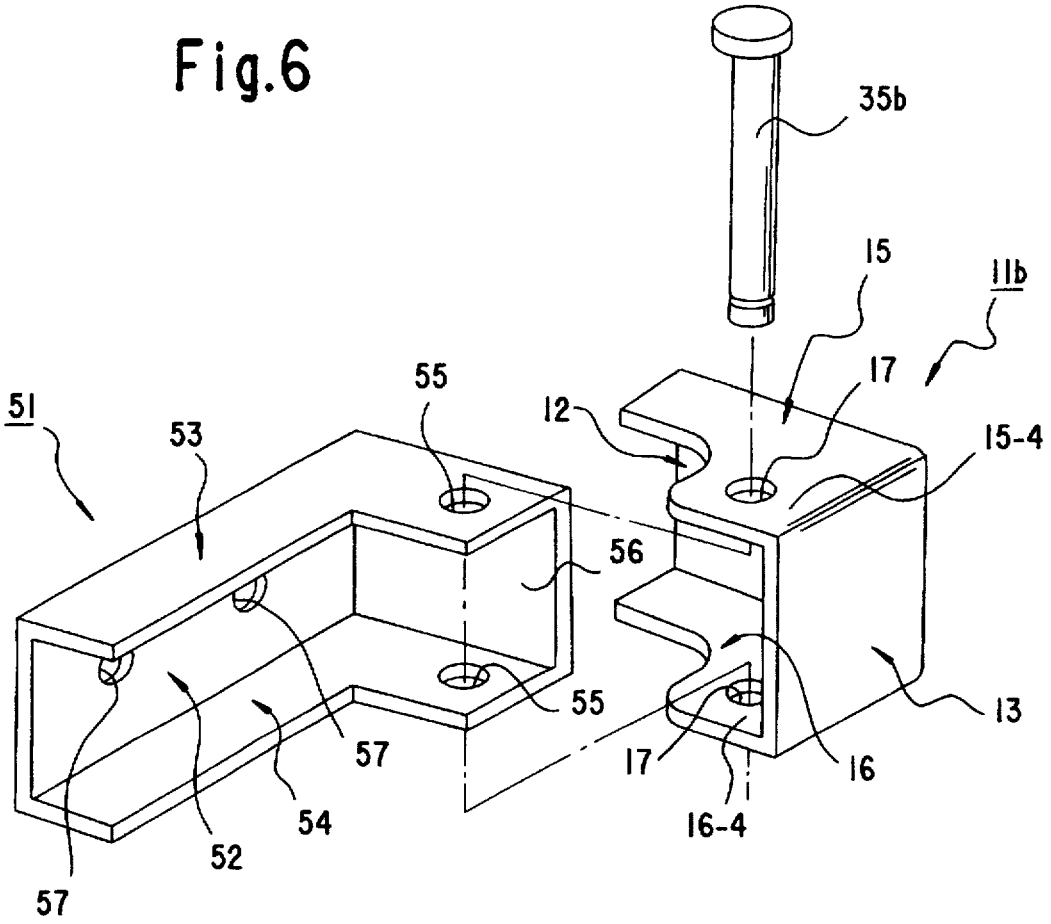
FIG. 6 is an exploded perspective view of another modified embodiment of the hinge structure of this invention.
Figure 7:
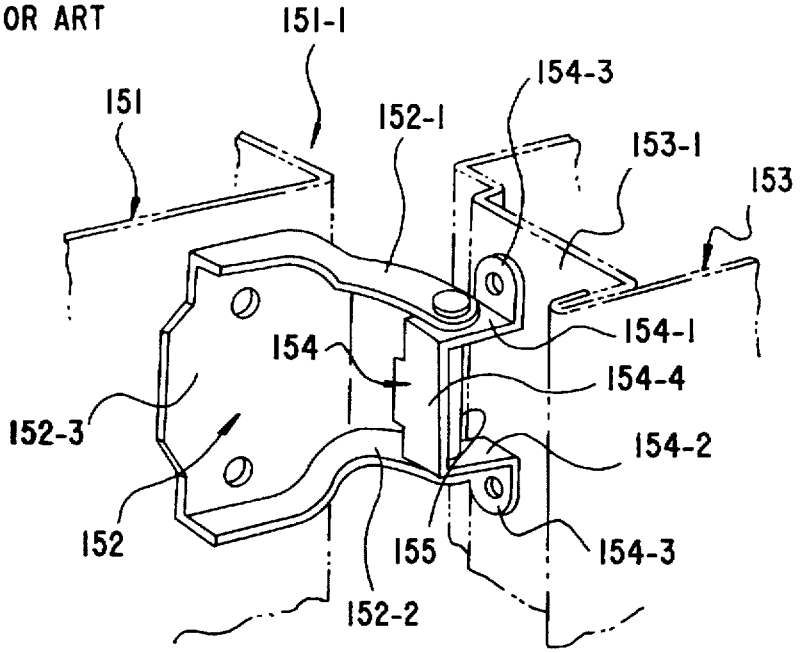
Fig.7 PRIOR ART
FIG. 7 is a perspective view of a conventional hinge structure.
Figure 8:
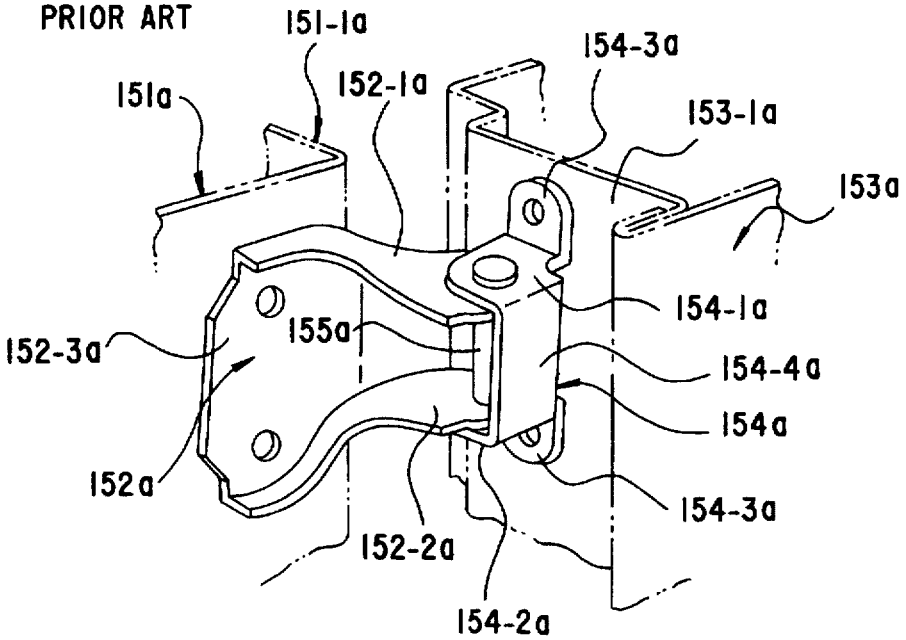
Fig.8 PRIOR ART
FIG. 8 is a perspective view of another conventional hinge structure.

FIG. 6 is an exploded perspective view of another modified embodiment of the hinge structure of this invention. In this embodiment, the structure of second hinge member 11*b* is not changed, and the same reference numerals are given to the same parts, so that the detailed description of such parts will be omitted.

In this embodiment, first hinge member 51 has the same structure as that of first hinge member shown in FIG. 1 and FIG. 4.

More specifically, first hinge member 51 consists of side pieces (supporting pieces) 53, 54 which are formed horizontally parallel and apart from each other and have coaxial pin holes 55, 55 for pivotable fitting to pivotably fit the hinge pin 35*b*, a vertical base piece 52 (fitting seating face) for connecting the side pieces 53, 54, and a front piece 56. The front piece 56 is substantially orthogonal to the base piece 52 in a plan view and, as a whole, the side pieces 53, 54, the base piece 52 and the front piece 56 are formed in the shape of letter L in a plan view, forming a continuous square C-shaped vertical cross section. Retaining the square C-shaped cross section, the section including the front piece 56 which is bent 90 degrees at the leading end of the base piece 52 forming the bottom of the square C-shaped cross section. First hinge member 51 basically has the same structure as second hinge member 11*b*, excepting the length, and can be formed by a single press forming of a steel plate material. The base piece 52 has two fitting holes 57, 57 formed and is bolted to the fitting face of the car body through the fitting holes 57, 57.

Thus, the above fitting structure of second hinge member 11 and first hinge member 51 has the same function and effect as in the above embodiment.

This invention consists of the side pieces 15, 16 (53, 54) which have the pin hole 17 (55) formed in one of the second hinge member and the first hinge member, as shown in FIG. 1 and FIG. 3, or both of the second hinge member and the first hinge member as in FIG. 6, the base piece 12 (52), and the front piece 13 (56). And, the front piece 13 (56) is preferred to be substantially orthogonal to the base piece 12 (52) in a plan view.

The preferable embodiments of this invention have been described in detail with reference to the drawings. But, this invention configures the second hinge member by the side pieces which have the pinholes and are formed horizontally parallel and apart from each other, the vertical base piece for connecting the side pieces, and the front piece; and the front piece is substantially orthogonal to the base piece in a plan view, so that the downward load, applied to the second hinge member, can be supported by the base piece and the front piece. In other words, when a certain load is supported by the base piece, another load, applied in a direction intersecting with the former load, can be supported by the front piece. Accordingly, this invention provides hinge structure having quite high rigidity and strength, as compared with a conventional hinge structure. This door hinge is not deformed largely, can keep doors, and others, installed at high precision for a long period, can keep them in position, and excels in practical use.

This invention forms one or both of the second hinge member and the first hinge member into an open box structure, having an L-shaped plan view and a square C-shaped vertical cross section, resulting in remarkable improvements in strength and rigidity, as compared with the prior art. The thickness of plate materials, such as a steel plate, can be reduced greatly. As a result, while keeping high strength and rigidity, the plate thickness can be reduced greatly and the hinge member's weight can be reduced. Because the plate material, such as a steel plate, is formed into the open box structure, having an L-shaped plan view and a square C-shaped vertical cross section, forming can be made easily by draw forming in a single process by using an upper and lower type metal mold, capable of facilitating the forming. Besides, because the thickness of plate materials, such as a steel plate material, can be reduced, the draw forming can be further facilitated, the forming mold structure can be simplified, the mold's service life can be extended, and the total cost of the hinge member can be reduced. In addition to the above, configuring the second hinge member structure, as described above, makes it sufficient to secure the second hinge member at one point by a single fitting work and improves the fitting workability.

As described above, this invention has many advantages.

What is claimed is:

1. A press formed automobile hinge structure comprising:

a first hinge member which forms one of a pair of hinge members to be secured to an opening of an automobile and to an openable member for opening and closing the opening;

a second hinge member which forms the other of said pair of hinge members; and a hinge pin which connects said first hinge member and said second hinge member, wherein said second hinge member has a pair of parallel spaced horizontal side pieces which have pin holes for receiving said hinge pin, a vertical base piece which connects said side pieces, and a vertical front piece orthogonal with said base piece and connected continuously along its opposite sides to said side pieces and along one of its ends to said base piece, wherein said first hinge member has a vertical base piece and a pair of spaced side pieces which are formed horizontally parallel at a top and a bottom of said base piece, said base piece having a leading end extending so as to form bifurcated leading sections, wherein said second hinge member is secured to the openable member of the automobile, and wherein said second hinge member has an L-shaped plan view and a square C-shaped vertical cross section, said side pieces of said first hinge member receive therebetween said second hinge member and are pivotally engaged with said hinge pin inserted vertically therethrough, and L-shaped sections of said side pieces of said second hinge member are contacted with said bifurcated leading sections of said base pieces of said first hinge member and form a stopper between said first and second hinge members.

2. A press-formed automobile hinge structure comprising:

a first hinge member for attachment to a body of an automobile adjacent to an opening defined therein, a second hinge member for attachment to an opening member for opening and closing the automobile body opening;

a hinge pin pivotally connecting said first hinge member and said second hinge member;

said second hinge member having a press-formed open box structure having a generally L-shaped plan view and a substantially square C-shaped cross-section, said second hinge member including a pair of parallel spaced horizontal side pieces having a pair of vertically aligned pin holes, respectively, for receiving therein said hinge pin, said horizontal side pieces having a generally L-shaped configuration composed of two arms connected together at one end, a vertical base piece joining said side pieces along one arm of said two arms, and a vertical front piece orthogonal with said base pieces and integrally connected with said pieces along the other arm of said two arms; and said first hinge member including a pair of parallel spaced horizontal, generally L-shaped side pieces having a pair of vertically aligned pin holes adjacent to one end thereof for receiving said hinge pin, and a vertical base piece joining said L-shaped side pieces and having bifurcated leading sections terminating short of said one end of said L-shaped side pieces.

3. A press-formed automobile hinge structure according to claim 2, wherein said first hinge member and said second hinge member are pivotally connected together by said hinge pin, with said side pieces on said second hinge member received between said side pieces of said first hinge member, said bifurcated leading sections of said first hinge member each having a leading end engagable with a joint portion of said two arms of a corresponding one of said side pieces of said second hinge member to form a stopper between said first and second hinge members.

4. A press-formed automobile hinge structure according to claim 2, wherein said first hinge member and said second hinge member are pivotally connected together with said hinge pin, with said side pieces of said first hinge member received between said side pieces of said second hinge member.

5. A press-formed automobile hinge structure according to any one of claims 2–4, wherein said base piece of said first hinge member is attachable to the body of the automobile, and said base piece of said second hinge member is attachable to said openable member.

* * * * *